United States Patent [19]

Silcox

[11] 4,044,407

[45] Aug. 30, 1977

[54] TOILET WATER SAVER DEVICE

[76] Inventor: George E. Silcox, 1532 Sierra Drive, Petaluma, Calif. 94952

[21] Appl. No.: 683,179

[22] Filed: May 4, 1976

[51] Int. Cl.[2] ..... E03D 1/22; E03D 1/34; E03D 5/02

[52] U.S. Cl. ..... 4/40; 4/67 A

[58] Field of Search ..... 4/14, 34, 35, 36, 37, 4/39, 40, 42, 49, 67 R, 67 A

[56] References Cited

U.S. PATENT DOCUMENTS

| | | | |
|---|---|---|---|
| 1,308,382 | 7/1969 | Van Deusen | 4/40X |
| 3,344,439 | 10/1967 | Davies | 4/40 |
| 3,431,564 | 3/1969 | Davies | 4/40 |

*Primary Examiner*—Richard E. Aegerter
*Assistant Examiner*—Stuart S. Levy
*Attorney, Agent, or Firm*—Melvin R. Stidham

[57] ABSTRACT

A water saving device for a toilet tank comprising an open top container with partitions forming an inverted U, siphon duct opening adjacent the bottom of the container and extending over an end wall to discharge below the container bottom. A top wall seals across the tops of the partitions, with a check valve therein to prevent the entrapment of air. A vent tube opens through the top wall from outside the toilet tank and a shut off valve is selectively operated to open or seal off the vent tube.

4 Claims, 3 Drawing Figures

TOILET WATER SAVER DEVICE

BACKGROUND OF THE INVENTION

There is a growing concern everywhere over the depletion of our natural resources, including fresh water suitable for consumption. A considerable amount of water is wasted in this country in the flushing of toilets. Most toilets are designed to discharge between four and five gallons each flushing, as that amount of water is deemed necessary in order to dispose of solid wastes adequately. However, when solid wastes are not involved, adequate flushing can be accomplished with substantially less water consumption. Others have devised various methods, including the placement of bricks, receptacles, or the like in the tank in order to displace or entrap water and thereby reduce the amount of water discharged during flushing. However, the purpose of such "water savers" is often defeated in that cases arise wherein the reduced amount of water is not sufficient to flush adequately and, hence, water is wasted by the requirement for additional flushings.

OBJECTS OF THE INVENTION

It is an object of this invention to provide a water saving device for a toilet tank which may be set selectively to reduce the amount of water discharged during a flushing.

It is a further object of this invention to provide a water saving device for a toilet tank which may readily be set to discharge the full amount of water for which the toilet tank was designed.

It is a further object of this invention to provide a water saving device for a toilet tank which may be installed in existing toilet tanks.

It is a further object of this invention to provide a selectively operated water saving device for a toilet tank which is simple to install and reliable in operation.

Other objects and advantages of this invention will become apparent from the description to follow when read in conjunction with the accompanying drawings.

BRIEF SUMMARY OF THE INVENTION

In carrying out this invention, I provide an open top container which is to be positioned in the toilet tank with its open top just below the normal surface of the water. The bottom of the container is elevated above the toilet tank bottom and has a high capacity check valve therein to facilitate filling the container as the water in the tank rises. One end wall of the container is slotted along the bottom, at least partially across its width, and two side walls or panels extend beyond it. An outer partition between the extended side walls terminates below the container bottom and an intermediate partition extending upward from below the bottom of the container forms an upward flow path from the slot in the end wall. A cover extends between the extended side walls to form, with the partitions, an inverted U-tube siphon from inside to outside the container. A check valve in the cover enables the evacuation of air as the U-tube is being filled and a vent tube extends from the cover to a position outside the toilet tank where it terminates in a manually operated on-off valve. When the tank is flushed with the vent open, in its "water saving" position, the water level in the outer leg of the inverted U-tube falls with the level of the water in the tank but atmospheric pressure acting against both the column of water in the upstanding leg of the U-tube and that in the open top container, keeps them in balance so that they fall only to the level of the intermediate partition. If, on the other hand, the tank is flushed with the vent valve closed, the dropping level of water level in the outer, depending leg of the inverted U-tube will create a vaccum in the U-tube above it to siphon the water from within the container up through the other leg of the siphon tube and out into the tank, thus using the full quantity of water in the tank and in the container.

DESCRIPTION OF A PREFERRED EMBODIMENT

Figure 1:
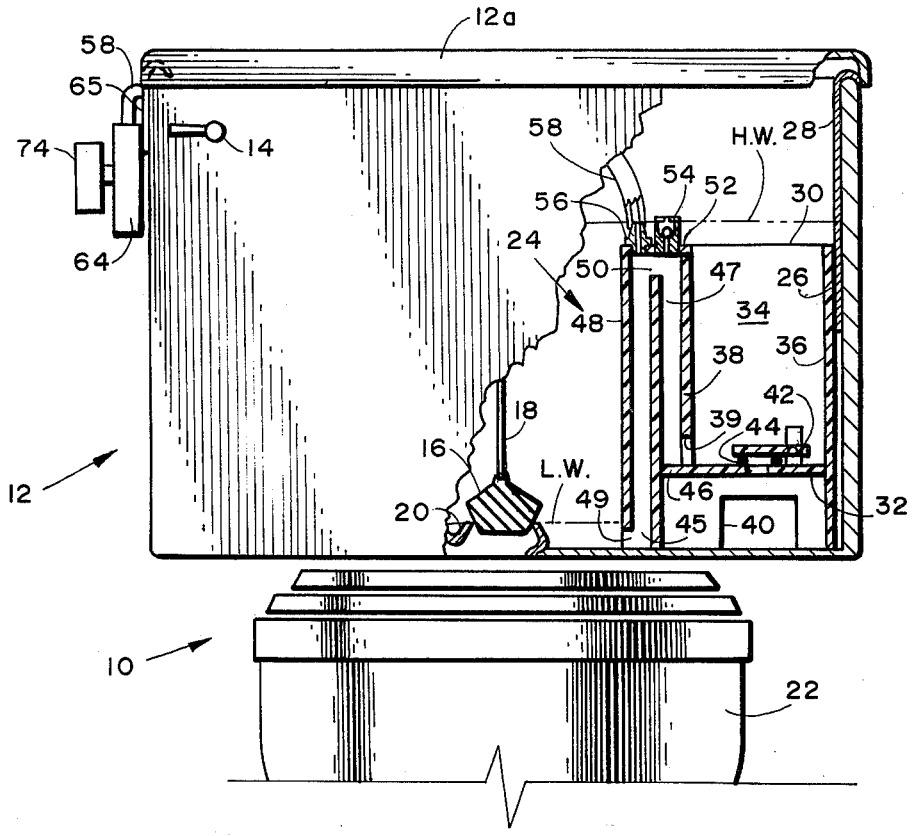
FIG. 1 is an elevation view, partially broken away, of a toilet tank in which the water saving device of this invention is installed.

Referring now to the drawings with greater particularity, there is shown a conventional flush toilet 10, with water tank 12 connected thereon to operate in the conventional manner. That is, when the control lever is pivoted 14, a globe type valve 16 is raised by a stem 18 from its seat 20 to allow water in the tank to drop from the high water level H.W. to the low water level L.W. to flush out the toilet bowl 22.

The water saving device 24 of this invention comprises an open top container 26 which is adapted to be positioned within the toilet tank 12, as by hanging it one the strap 28, so that the open top 30 is below the high water level H.W. The bottom 32 of the container 26 is elevated above the lower ends of the side walls 34 and the end walls 36 and 38, and an opening 40 in at least one of the walls 34 and 36 enables water to enter freely and flow through a one way swing-type check valve 42 to fill the container. When the container is filled and flow ceases, the swing check valve 42 returns to the position shown whereby a suitable resilient seal, such as an O-ring 44, carried thereon seals against the container bottom.

As shown, one of the end walls 38 is slotted at 39 adjacent the container bottom 32 at least partially across the width thereof, and side and bottom wall extensions 45, 46 extend beyond it. Two partitions 47 and 48 extend to seal between the side wall extensions 45, 34. The inner partition 47 extends upward from below the container bottom 32, to a level just below the top of the container 26 with the bottom wall extension 46 sealing across the face thereof. The outer partition 48, also terminates below the container bottom 32, but above the bottom of the toilet tank to form a discharge opening 49. Hence, the partitions 47 and 48, with the slotted end wall 38 form an inverted U-shaped, siphon passage 50 from within the chamber 26 to the discharge opening 49 below the bottom 32 thereof. A top wall 52 seals between the partition 48, the end wall 38 and the extended sides 45, and opening from it is an air check valve 54 which enables the evacuation of air from within the inverted U-tube or air duct 50 as it is filled with water. Also opening into the inverted U-duct 50 is a port 56 to which is connected a vent tube 58 to extend outside of the tank 12 under the lid **12*a* thereof, which may be raised by suitable shims 60 (FIGS. 2 and 3) to prevent squeezing the tube. The vent tube 58 terminates in the vent port 62 which is carried in a valve control box 64 which may be secured to the side of the toilet tank 12, as by means of suspending strap 65**.

The valve control box 64 is open on at least one side 66 to the atmosphere, and includes a suitable valve clapper 68 which is pivoted at 70 to the side of the control box. The valve clapper 68 carries a resilient stopper 72 of rubber or the like to seal against the vent port 62 when in closed position shown in FIG. 3 to prevent venting the U-duct 50. Rotatably carried in the valve box is the operator lever 74, on the shaft 76 of which is carried the valve cam arm 78. When the handle 74 is turned counterclockwise from the position shown in FIG. 2, the arm 78 cams the valve clapper 68 counterclockwise to the position shown in FIG. 3 wherein the plug 72 is engaged firmly against the valve port 62 to prevent any venting of air. As will now be described, the vented position of FIG. 2 is that in which the device saves water while the sealed position of FIG. 3 is that in which a full water discharge is achieved.

Figure 2:
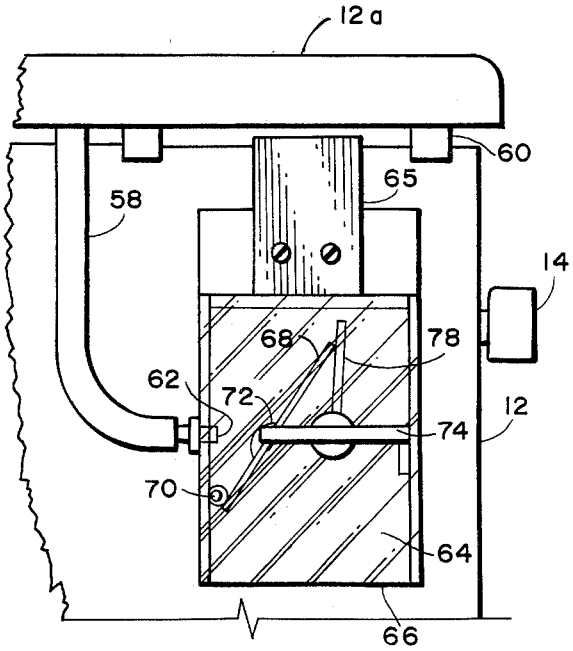
FIGS. 2 and 3 are partial side views of the toilet tank showing the vent valve component of the water saving device in its two operational phases.

In the vented position of FIG. 2, the inverted U-duct 50 is open to the atmosphere. Hence, when the toilet tank globe valve 16 is lifted from its seat 20, the water level begins to fall from the high water level H.W. and the water in the outer leg of the inverted U-tube 50 falls with it, discharging through outlet 49. When the water level falls below the top of the intermediate partition 47, atmospheric pressure acting on the columns of water within the container 26 and within the inner partition 47 keeps them at the same level so that the communicating columns of water within the container as a whole do not fall below the level of the partition 47, although the column within the outer partition 48 continues to fall with the level in the toilet tank 12.

Figure 3:
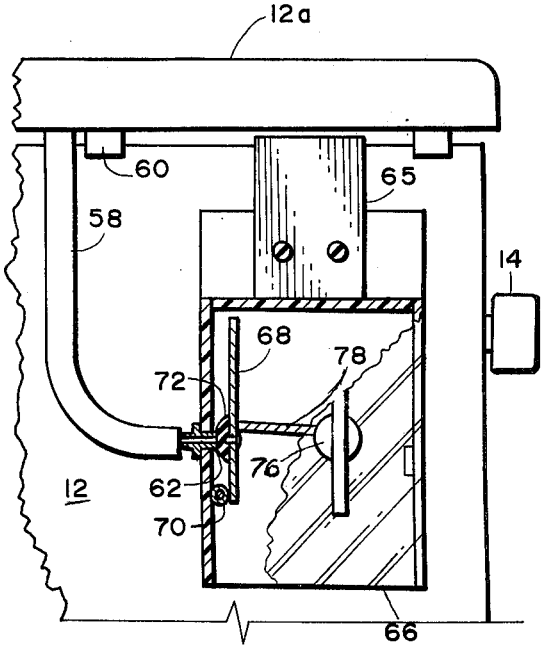

When the operating handle is moved to the position shown in FIG. 3 with the clapper valve 68, 72 sealed, and the toilet tank globe valve 16 is lifted from its seat 20, the lowering of the water level within the outer partition 48 of the U-duct 50 creates a vacuum above it, which vacuum is opposed by atmospheric pressure acting against the water in the open top container 26. Hence, atmospheric pressure acting against the water in the open top container 26. Hence, atmospheric pressure will force the water up through the inner compartment 47 of the U-duct and down and out the outer compartment 48 to discharge with the water within the toilet tank, hence, effecting a full water discharge by siphoning action.

I have found that the container can be made of a capacity of ½ gallon or more to effect a considerable savings in the vast majority of the times the toilet is flushed when a full discharge is not required.

While this invention has been described in conjunction with a preferred embodiment thereof, it is obvious that modifications and changes therein may be made by those skilled in the art without departing from the spririt and scope of this invention as defined by the claims appended hereto.

What is claimed as my invention is:

1. A toilet tank water saving device comprising:

an open top container with generally vertical side and end walls, and a bottom wall adapted to be positioned in a toilet tank above the bottom thereof:

an aperture in one end wall adjacent said bottom wall;

spaced upright side wall members extending outward from said one end wall, said side wall members extending vertically from the tops of said container to below said bottom wall;

an outer partition spanning the ends of said side wall members from the top therof to below said bottom wall and being spaced from the bottom of said tank;

a cover spanning the tops of said sidewall members, said one end wall and said outer partition;

an intermediate partition spanning said side panels from below said cover to below said bottom wall and spaced between said one end wall and said outer partition to form an inverted U-tube has been inserted after "wall".

means sealing between said intermediate partition and said bottom wall;

a check valve in the lower portion of said container to enable one-way flow therein; and means selectively operable to vent the inverted U-tube to the atmosphere.

2. The device defined by claim 1 wherein said last-named means comprises:

a port in said cover;

a vent tube connected at one end thereof to said port and open at the other end to the atmosphere; and valve means selectively operable to close off said vent tube.

3. The device defined by claim 2 including:

means for supporting said valve means on the outside of said toilet tank.

4. The device defined by claim 2 including:

a pneumatic check valve on said cover enabling one-way air flow therefrom.

* * * * *